US007580324B2

(12) United States Patent
Dancsecs et al.

(10) Patent No.: US 7,580,324 B2
(45) Date of Patent: Aug. 25, 2009

(54) DRIVE WHEEL FOR INTEGRATION INTO A CLOCK MOVEMENT

(75) Inventors: Laszlo Dancsecs, Feuerthalen (CH); Pascal Schweizer, Schaffhausen (CH); Denis Zimmermann, Kreuzlingen (CH)

(73) Assignee: Richemont International SA, Villars-sur-Glane (CH)

( * ) Notice: Subject to any disclaimer, the term of this patent is extended or adjusted under 35 U.S.C. 154(b) by 33 days.

(21) Appl. No.: 11/822,221

(22) Filed: Jul. 3, 2007

(65) Prior Publication Data

US 2008/0013406 A1 Jan. 17, 2008

(30) Foreign Application Priority Data

Jul. 14, 2006 (CH) ..... 1142/06

(51) Int. Cl.
*G04B 19/02* (2006.01)
*G04B 19/06* (2006.01)
*G04B 19/20* (2006.01)

(52) U.S. Cl. ..... 368/220; 368/37; 368/77; 368/221; 368/233; 74/437; 74/460; 74/414

(58) Field of Classification Search ..... 368/35, 368/37, 220, 221, 322, 323, 77; 74/437, 74/460–462, 530, 414
See application file for complete search history.

(56) References Cited

U.S. PATENT DOCUMENTS 2,985,028 A * 5/1961 Napolin et al. ..... 74/409
3,496,791 A 2/1970 Gabriel
4,127,041 A 11/1978 Imazaike
4,142,363 A 3/1979 Guyot et al.
4,161,099 A * 7/1979 Storz ..... 368/35
4,473,301 A * 9/1984 Namyslo ..... 368/35
6,097,672 A 8/2000 Kitahara et al.
7,258,037 B2 8/2007 Wiederrecht
2007/0180943 A1 8/2007 Daout

FOREIGN PATENT DOCUMENTS

| | | | |
|---|---|---|---|
| CH | 623 191 | G | 5/1981 |
| EP | 0 895 142 | A1 | 2/1999 |
| EP | 1 380 772 | A1 | 1/2004 |
| EP | 1 555 584 | A1 | 7/2005 |
| FR | 2 379 736 | | 9/1978 |
| GB | 526187 | | 9/1940 |
| JP | 63-130961 | | 6/1988 |

* cited by examiner

*Primary Examiner*—Renee S Luebke
*Assistant Examiner*—Thanh S Phan
(74) *Attorney, Agent, or Firm*—Young & Thompson

(57) ABSTRACT

A drive wheel for integration into a clock movement, in particular into the clock movement of wristwatches, with at least a dented section by whose teeth a downstream wheel is rotatably drivable and at least a non-dented section which has a diameter chosen in such a manner that the part-circular circumference of the drive wheel in the non-dented section blocks the downstream wheel against rotation while the teeth of the downstream wheel face this section. The non-dented section of the drive wheel includes at least a flexible element that is arranged, seen in the direction opposite to the direction of rotation of the drive wheel, immediately after the dented section and that includes an elasticity essentially directed in radial direction of the drive wheel for the change of the diameter of the non-dented section of the drive wheel in the range of the flexible element.

14 Claims, 2 Drawing Sheets

DRIVE WHEEL FOR INTEGRATION INTO A CLOCK MOVEMENT

FIELD OF THE INVENTION

The present invention concerns a drive wheel according to the preamble of claim 1 which is adapted for integration into a clock movement, in particular into that of a wristwatch, and which is used preferentially for the control of indications as for instance date indications.

DESCRIPTION OF THE RELATED ART

As is known from the relevant state of the art, for instance the documents U.S. Pat. No. 4,473,301 or GB 526,187, such a drive wheel has at least a dented section by whose teeth a wheel on the downstream side of the gear train is rotatably drivable and at least a non-dented section. Here, the circumference of the latter serves as locking surface in order to prevent rotation of the downstream wheel during the driving breaks. For that purpose, the drive wheel comprises at its non-dented section a diameter chosen in such a manner that the part-circular circumference of the drive wheel in the non-dented section blocks the downstream wheel against rotation during the facing of this section and the teeth of the downstream wheel.

Such wheels are used frequently, for example as mentioned as program wheels in gear trains for the date indication in watches or similar mechanisms, and are in particular of interest because, due to the independent blocking of the downstream wheel, they render redundant any separate stop spring for the blocking of the downstream wheel during the passing-by of the non-dented section of the drive wheel, when the wheel to be driven of course shall not rotate. Thus, applying an additional torque for overcoming the stop spring force will be avoided when the dented section of the drive wheel engages into the downstream wheel and, therefore, only the torque necessary for the rotation of this wheel has to be applied.

However, during the driving process respectively during the course of the relative motions of the wheels to each other there may occur a malfunction with wheels arranged in such a manner, for example due to the play between the wheels of the gear train, which leads to the blocking of the gear train and thus to a malfunctioning of the clock movement respectively of the indication of the watch.

SUMMARY OF THE INVENTION

It is the object of the present invention to overcome these difficulties and it aims at the realization of a drive wheel of the above described type which allows to avoid such malfunctions without having to fall back to stop springs for the downstream wheel. Besides, the drive wheel should be adapted to be produced simply, fast and economical and be as versatile as possible in its applicability. In use, it therefore should be robust, space-saving and applicable to different types of gear trains without substantial changes.

The present invention thus concerns a drive wheel which solves the aforementioned objects by the teaching of claim 1, by comprising the characteristics specified in the characteristic part of claim 1.

In particular, the subject matter of the invention is characterised by the fact that the non-dented section of the drive wheel comprises at least a flexible element that is arranged, seen in the direction opposite to the direction of rotation of the drive wheel, immediately after the dented section and that comprises an elasticity essentially directed in radial direction of the drive wheel for the change of the diameter of the non-dented section of the drive wheel in the range of the flexible element.

This has the advantage that the downstream wheel, as it were, is led by the flexible element in its correct course respectively position, without being able to cause malfunctions.

The flexible element can be chosen here for example as bendable spring tongue or as arc-shaped element made of flexible material, like will be defined here below in greater detail.

This allows to produce the drive wheel very simply and economically, since it can be even in one piece, and to use it as versatile as possible, since it may be carried by a conventional bearing, since the wheel despite its flat and space-saving method of construction is nevertheless robust, and since it can be integrated into the most diverse types of gear trains, which may for example also comprise wheels mutually inclined with respect to each other.

Favourable developments of the invention concern the arrangement of the end of the flexible element pointing to the dented section of the drive wheel, which may in particular comprise a tip of a tooth of smaller height relative to the teeth of the dented section. The shaping of this tip of a tooth is again the subject of further embodiments.

Further advantages result from the characteristics specified in the dependent claims as well as from the description illustrating in the following the invention in the detail with the help of the figures.

BRIEF DESCRIPTION OF THE SEVERAL VIEWS OF THE DRAWINGS

The attached figures represent exemplarily two embodiments of a drive wheel according to the present invention.

DETAILED DESCRIPTION OF THE PREFERRED EMBODIMENTS

In the following, the invention is to be described in detail with reference to the above mentioned figures.

Figure 1:
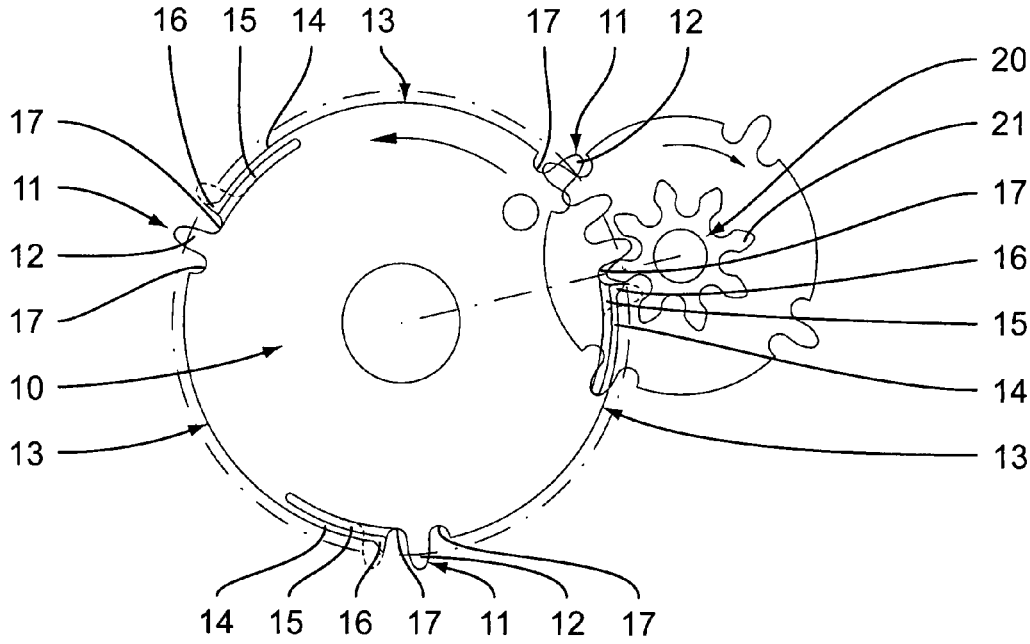
FIG. 1 illustrates schematically and exemplarily the structure of a first embodiment of a drive wheel according to invention, wherein it is represented in engagement with a downstream wheel.

In FIG. 1 a drive wheel 10 according to the invention is represented which is adapted for the integration into a clock movement, in particular into the clock movement of wristwatches. Such a drive wheel 10 comprises at least a dented section 11 by whose teeth 12 a downstream wheel 20 is rotatably drivable and at least a non-dented section 13. The latter has a diameter chosen in such a manner that the part-circular circumference of the drive wheel 10 in the non-dented section 13 blocks the downstream wheel 20 against rotation during the passing-by of this non-dented section 13 of the drive wheel in front of the downstream wheel 20, during which this wheel 20 is evidently supposed not to rotate, thus when the teeth 21 of the downstream wheel 20 face this section. In the illustrated example, the drive wheel has three toothed—11 respectively non-dented sections 13, whose number of teeth respectively length does not need to be identical. This choice of the number of dented—and non-dented sections is only an example and, in particular, also the number of teeth of a dented section 11 can be selected arbitrarily, especially also relative to that of the downstream—or upstream wheel, and only depends on the corresponding application in connection with a given gear train, which determines the computation of these parameters, which however are not of further importance for the present invention. For the sake of completeness, a widespread application of such drive wheels shall be mentioned, which consists in the use as program wheels in watches with date indication, in particular in wristwatches. Depending upon the indication of the number of the day, of the month or of the year and the degree of automation of the respective indication, the program wheel comprises in each case corresponding sectors with an appropriate number of teeth respectively length.

From FIG. 1 it is further evident that each non-dented section 13 of the drive wheel 10 comprises a flexible element 14, which is arranged, seen in the direction opposite to the direction of rotation of the drive wheel 10, immediately after the dented section 11. Such an flexible element 14 comprises an elasticity essentially directed in radial direction of the drive wheel 10 for the change of the diameter of the non-dented section 13 of the drive wheel 10 in the range of the flexible element 14. Preferably, the flexible element 14 may consist of an arc-shaped element, which is arranged concentrically with respect to the centre of the drive wheel 10 and forms in undeformed condition a sector of the part-circular outer circumference of the non-dented section 13 of the drive wheel 10.

Thus, the drive wheel 10 has within the range of the non-dented section(s) 13 in the undeformed condition of the flexible element 14 noticeably a continuous part-circular outer circumference, which is interrupted essentially only by the dented section(s) 11 and which form(s) the aforementioned locking surface for the locking of the downstream wheel 20. This outer circumference can however, as it were, be deformed inwardly due to the radial elasticity of the element 14 at the location of its emplacement, which allows, during the progressive rotation of the drive wheel 10, to lead the downstream wheel 20 into its correct course respectively position at the critical phase of the process of engagement of the two wheels 10, 20, at the transition of the dented—11 to the non-dented section 13, without causing malfunctions in the gear train.

Before the functional sequence of this process will be described in detail, the first specific embodiment of a drive wheel according to the invention, such as illustrated in FIG. 1, shall be described in still greater detail. In this case the flexible element 14 was chosen exemplarily as bendable spring tongue. Its end pointing to the non-dented section 13 of the drive wheel 10 is fastened to the drive wheel, whereas the end pointing to the dented section 11 of the drive wheel 10 of the arc-shaped element 14 realized as spring tongue is freely bendable. The bending is enabled by a longitudinally formed slot 15 arranged along the side of the spring tongue 14 directed radially to the centre of the drive wheel, the slot 15 being formed in the drive wheel 10 in parallel to the outer circumference, insofar the spring tongue thus can be pressed radially inwardly by the teeth 21 of the downstream wheel 20 against its spring action. It is obvious that in this embodiment the flexible element 14 can be manufactured in one piece with the non-dented section 13 of the drive wheel 10 in order to guarantee a simple and fast production.

Moreover, the flexible element 14 may comprise at its end pointing to the dented section 11 of the drive wheel 10 a tip of a tooth 16 of smaller height relative to the teeth 12 of the dented section 11. This additionally serves the already mentioned safe guidance of the downstream wheel 20 into the desired position at the transition of the dented—11 into the non-dented section 13 of the drive wheel 10, as the spring action exercised by the flexible element 14 on the teeth 21 of the downstream wheel 20 may thereby be optimally transferred on the latter and snapping back of the wheel 20 may be prevented.

In particular, the tip of a tooth 16 of the spring tongue respectively in general of the flexible element 14 may have, at its flank pointing to the dented section 11 of the drive wheel 10 up to its point, a profile which is identical to the one of a tooth 12 of the dented section 11 of the drive wheel 10, such as is shown in FIG. 1 by an imaginary tooth suggested by a dashed line and overlaying the free end of the spring tongue 14. In contrast to this, the flank of the tip of a tooth 16 pointing to the non-dented section 13 of the drive wheel 10 can favourably be formed as a side surface sloping essentially linearly down to the outer circumference of the non-dented section 13. Thus, on the one hand an optimal engagement of the corresponding tooth 21 of the downstream wheel 20 also after the last tooth 12 of each dented section 11 is obtained, on the other hand the linearly sloping side surface serves as sliding surface during the guidance of the downstream wheel 20 into the desired position on the non-dented section 13 of the drive wheel 10.

Furthermore, the power transmission can be improved by providing the teeth 12 of the dented section 11 of the drive wheel 10 as well as the flank of the tip of a tooth 16 of the flexible element 14 pointing to this section 11 with a profile having a so-called pointed elbow radius. In this case, also the teeth 21 of the downstream wheel 20 normally comprise a profile with a pointed elbow radius, wherein the specific radius of the shape of the pointed arch may be chosen differently by the person skilled in the art as a function of the application and further parameters known to him.

It is still to be mentioned that, of course, directly before and after each dented section 11 of the drive wheel 10 a recess 17 corresponding essentially to the recess at the shoulder of the teeth between two teeth 12 within a dented section 11 is formed, in order to allow for the partial rotation of the downstream wheel 20 also at the transition regions between dented—11 and non-dented section 13 of the drive wheel. Therefore, only after the recess 17 behind the dented section 11 follows the flexible element 14 in the non-dented section 13.

Figure 2A:
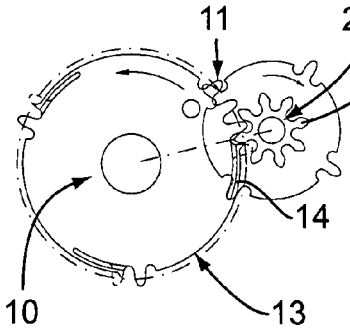
FIGS. 2*a* to 2*f* illustrate the functioning of a transmission gear with such a drive wheel by means of schematic illustrations of the succession of the engagement between the drive wheel and the downstream wheel.
Figure 2B:
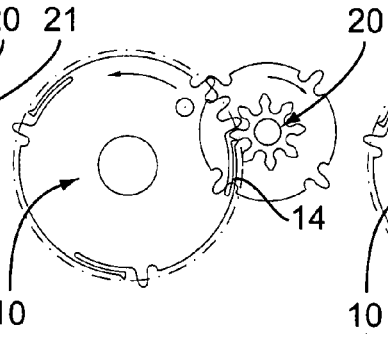
Figure 2C:
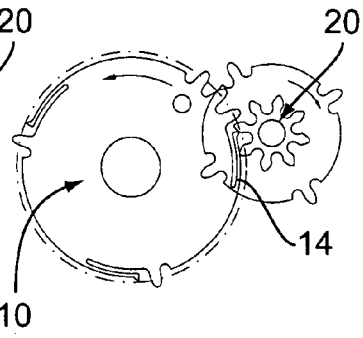
Figure 2D:
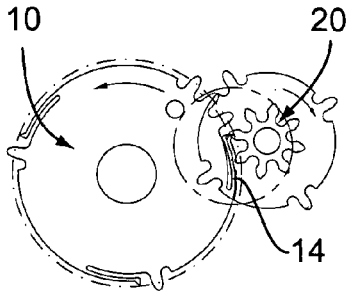
Figure 2E:
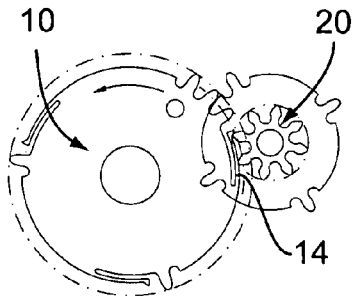
Figure 2F:
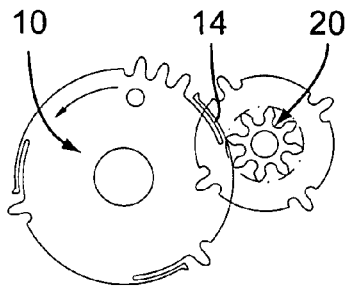
Figure 3:
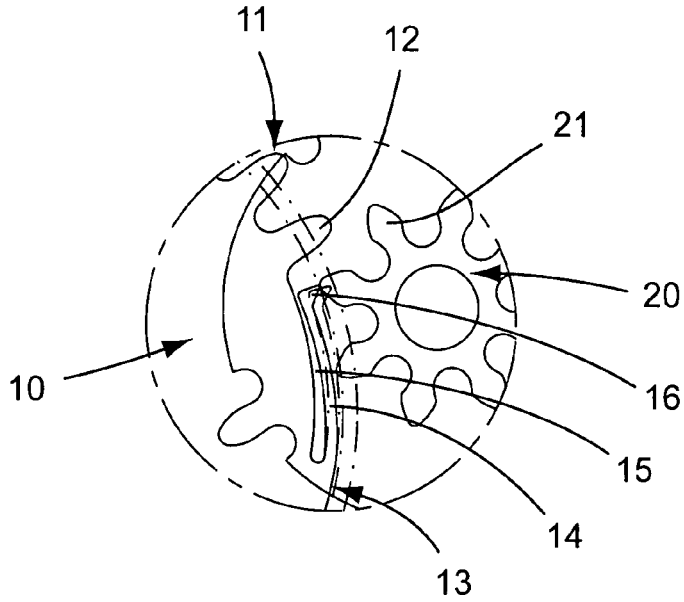
FIG. 3 is a detailed illustration of FIG. 2*d*.

With reference to FIGS. 2*a* to 2*f*, the functional sequence of the engagement of the wheels 10, 20 is now to be described in the following. FIG. 2*a* thereby shows a snapshot near the end of the engagement of the last tooth of a dented section 11 into the teeth 21 of the downstream wheel 20. Here, a tooth 21 of this wheel is essentially radially aligned in the recess 17 after the dented section 11 of the drive wheel. In the case of a further rotation of the drive wheel 10 this tooth and thus the wheel 20 will initially still be rotated by some amount by the leading edge of the flexible element 14, which resembles a tooth of smaller height, see FIG. 2*b*, but only until the following tooth of the wheel 20 comes in touch with the outer circumference of the non-dented section 13 of the drive wheel 10, such as represented in FIG. 2*c*. The further rotation of the drive wheel 10 causes the fact that, depending upon the arrangement of the end of the flexible element oriented towards the dented section 11, the flexible element 14 is bent radially inwardly, since a possibly existing tip of a tooth 16 at this end has to slide below the first mentioned tooth of the downstream wheel 20, while the following tooth of this wheel 20 rests against the outer circumference of the non-dented section 13 of the drive wheel. This is represented in FIG. 2*d* as well as, in detail, in FIG. 3, in which it is also shown that during this step the point of the latter tooth of the downstream wheel 20 can penetrate, due to the deformation of the flexible element 14 which for this purpose must have a sufficient length of at least once the distance between two teeth at the downstream wheel, by a small amount within the outer circumference of the non-dented section 13 of the drive wheel 10, which thus corresponds to a further rotation by a small amount of the downstream wheel 20 as compared to the situation of the preceding step, which is shown in FIG. 2*c*, and which facilitates passing of the tip of the free end of the flexible element 14 under the first mentioned tooth of the downstream wheel 20. As soon as this took place, the first mentioned tooth of the downstream wheel 20 finally slides over the linearly sloping-down side of the tip 16 on the flexible element 14 until it hits the normal outer circumference of the non-dented section 13 of the drive wheel 10, which is represented in FIG. 2*e* and wherein the sliding motion is promoted by the resetting force of the flexible element 14. Any sliding back of the wheel 20 is prevented by this conception in effective manner. Following this step, one of the two mentioned teeth of the downstream wheel 20 is in contact with the outer circumference of the non-dented section 13 of the drive wheel 10, while the other one of the two teeth faces, with small play, the outer circumference, such that during further rotation of the drive wheel 10 the two teeth block the wheel 20 against any rotation, until a dented section 11 on the drive wheel engages again into the teeth 21 of the wheel 20, see FIG. 2*f*. In this way, without having to fall back on a stop spring for the locking of the wheel 20, a safe guidance of this wheel 20 into a self-blocking position at the drive wheel 10 and under avoidance of a backward motion or blocking of the following wheel 20 is made possible.

Another, however simpler case, being identical with respect to the principle of the radial deformation of the flexible element 14, is the one where no tip of a tooth 16 exists at the end of the flexible element 14 turned towards the dented section. Here, the above mentioned rotation by a small amount of the downstream wheel 20 does not take place via the tip 16 at the flexible element 14, but only in case of sometimes arising, not correctly working engagement between the wheels 10, 20, wherein the radial deformation of the flexible element 14 and the corresponding resetting force again allow to guide the downstream wheel 20 at the transition between dented—11 and non-dented section 13 of the drive wheel 10 and to avoid a blocking of the wheels one into another as well as a corresponding malfunction of the clock.

It is obvious after these explanations that the radial elasticity of the flexible element 14 permits safe guidance as well as avoiding any blocking of the wheels 10, 20. Moreover, by the above mentioned shaping especially of the tip of a tooth 16 of the flexible element 14 at its side oriented towards the dented section, on the one hand an optimal engagement of the corresponding tooth 21 of the downstream wheel 20 also after the last tooth 12 of each dented section 11 can be obtained, and on the other hand the guidance of the downstream wheel 20 into the desired position at the non-dented section 13 of the drive wheel 10 can be improved by a side surface sloping for example linearly downward at its side turned away from the dented section for providing a sliding surface.

It shall further be mentioned that the above mentioned rotation by a small amount of the downstream wheel 20 due to the radial elasticity of the flexible element 14 for example in the form of the spring tongue, on the one hand, is very small and, on the other hand, is absorbed by the play between the wheels of the gear train in such a manner that altogether no movement in the associated indication is visible for the user of the watch. In no case, a wheel downstream of the wheel 20 may be advanced by this.

Finally, it is pointed out that the spring tongue and/or the flexible element of the above illustrated first embodiment of a drive wheel according to the invention can, of course, be realized quite differently and can be fastened to the drive wheel according to its deviating shaping, insofar as they are functionally equivalent. The dimension and the shape of such a spring therefore can deviate in quite strong manner from the represented variant, may for example be L-shaped and therefore be fastened to the drive wheel in radial direction, etc., and are to be adapted with regard to the conception of the spring force and dimensioning to a given gear train.

Figure 4:
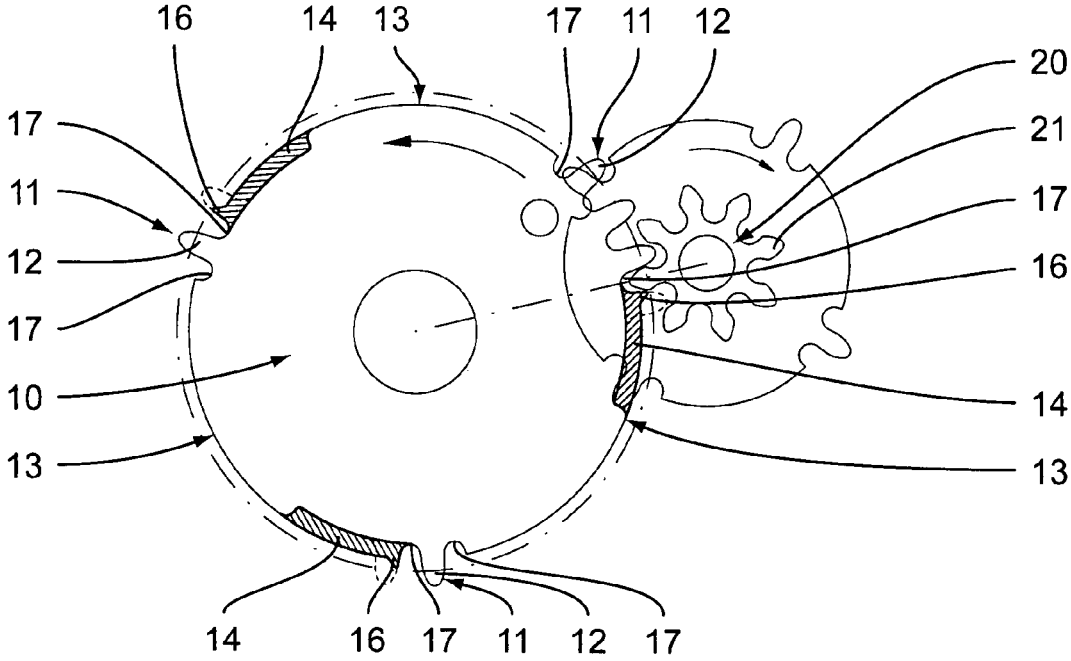
FIG. 4 shows similarly to FIG. 1 in a schematic way the structure of a second embodiment of a drive wheel according to the invention.

In order to underline what has been said previously, FIG. 4 specifically represents—again only exemplarily—a second embodiment, in which the flexible element 14 is realized as arc-shaped element made of sufficiently flexible material. The chosen flexible material permits a radial deformation corresponding to the above described for the change of diameter of the non-dented section 13 of the drive wheel 10 within the range of the flexible element 14. Instead of a longitudinally formed slot 15 formed in the drive wheel, which permits its bending in the case of the spring tongue, the flexible element 14 is attached in this case in the non-dented section of the drive wheel 10 in an appropriate recess having the same size as the element 14, insofar as due to the high elasticity of the material of the element 14 no recess in the drive wheel 10 is needed. All other remarks regarding the shaping, in particular also concerning its tip at the end oriented towards the dented section 11 of the drive wheel, as well as the functional sequence are also valid for this embodiment without any reservation.

Finally it is noted that both embodiments may be realized in a bi-directional variant, by adding at the other end of each non-dented section 13 of a drive wheel 10 a corresponding flexible element 14.

The present invention thus provides a self-locking drive wheel which can be produced simply and economically, by means of which the downstream wheel can be guided safely and without danger of rotating backwardly or blocking into the self-locking position. The resistance to torque can thus be kept minimal while the danger of a malfunctioning is reduced. Besides, the drive wheel according to the invention can be carried in completely classical manner by bearings, is robust and as space saving as corresponding conventional program wheels. Beyond this, it can be used without difficulties in different types of gear trains, for example also in wheel systems which comprise wheels arbitrarily inclined against each other.

The invention claimed is:

1. A drive wheel (10) for integration into a clock movement, comprising:

a dented section (11) having teeth (12), the teeth configured to rotatably drive a downstream wheel (20); and a non-dented section (13) having a diameter configured such that a part-circular circumference of the drive wheel (10) in the non-dented section (13) blocks the downstream wheel (20) against rotation while teeth (21) of the downstream wheel (20) face the non-dented section, wherein the non-dented section (13) comprises at least a flexible element (14) arranged, in a direction opposite to a direction at rotation of the drive wheel (10), immediately after the dented section (11), and that comprises an elasticity essentially directed in a radial direction of the drive wheel (10) for a change of the diameter of the non-dented section (13) in a range of the flexible element (14).

2. The drive wheel according to claim 1, wherein the flexible element (14) consists of an arc-shaped element arranged concentrically with respect to the center of the drive wheel (10), and forms in undeformed condition a sector of a part-circular outer circumference of the non-dented section (13).

3. The drive wheel according to claim 2, wherein a first end of the flexible element (14) pointing to the non-dented section (13) is fastened to the drive wheel, wherein a second end of the flexible element pointing to the dented section (11) is formed of a freely bendable spring tongue, and wherein a longitudinally formed slot (15) is arranged in the drive wheel (10) along a side of the spring tongue directed radially to the centre of the drive wheel.

4. The drive wheel according to claim 3, wherein the flexible element (14) is manufactured in one piece with the non-dented section (13).

5. The drive wheel according to claim 2, wherein the flexible element (14) consists of an arc-shaped element made of flexible material, configured to allow deformation for the change of the diameter of the non-dented section (13) within the range of the flexible element (14), and wherein the flexible element (14) is arranged in a corresponding recess at the non-dented section (13).

6. The drive wheel according to claim 1, wherein the flexible element (14) consists of an arc-shaped element made of flexible material, configured to allow a deformation for the change of the diameter of the non-dented section (13) within the range of the flexible element (14), and wherein the flexible element (14) is arranged in a corresponding recess at the non-dented section (13).

7. The drive wheel according to claim 1, wherein the flexible element (14) comprises, at an end pointing to the dented section (11), a tip of a tooth (16) of smaller height relative to the teeth (12) of the dented section (11).

8. The drive wheel according to claim 7, wherein the tip of the tooth (16) of the flexible element (14) has, at a flank pointing to the dented section (11) up to a point of the tip, a profile of one of the teeth (12) of the dented section (11), and the flank of the tip of the tooth (16) pointing to the non-dented section (13) is formed as a side surface sloping essentially linearly down to the outer circumference of the non-dented section (13).

9. The drive wheel according to claim 8, wherein the teeth (12) of the dented section (11) and the flank of the sip of the tooth (16) of the flexible element (14) pointing to the dented section (11) exhibit a profile of a pointed elbow radius.

10. The drive wheel according to claim 7, wherein the teeth (12) of the dented section (11) and the flank of the tip of the tooth (16) of the flexible element (14) pointing to the dented section (11) exhibit a profile of a pointed elbow radius.

11. The drive wheel according to claim 1, wherein an accordingly oriented flexible element (14) is arranged at ends of the dented section (11).

12. The drive wheel according to claim 1, wherein, directly before and after the dented section (11), a recess (17), corresponding essentially to a recess at a shoulder of the teeth within the dented section (11), is formed in the drive wheel (10) for allowing the partial rotation of the downstream wheel (20).

13. The drive wheel according to claim 1, wherein the drive wheel is configured for integration into a clock movement of a wristwatch.

14. A clock movement, comprising:

a drive wheel (10) according to claim 1; and a downstream wheel (20) in engagement with and configured to be driven from the drive wheel (10).

* * * * *